US011597476B2

(12) United States Patent
Fields

(10) Patent No.: US 11,597,476 B2
(45) Date of Patent: Mar. 7, 2023

(54) CONTROLLED FAILURE POINT FOR A ROPE OR MOORING LOOP AND METHOD OF USE THEREOF

(71) Applicant: Thomas W. Fields, Wadsworth, OH (US)

(72) Inventor: Thomas W. Fields, Wadsworth, OH (US)

( * ) Notice: Subject to any disclaimer, the term of this patent is extended or adjusted under 35 U.S.C. 154(b) by 0 days.

(21) Appl. No.: 17/405,816

(22) Filed: Aug. 18, 2021

(65) Prior Publication Data

US 2022/0063768 A1 Mar. 3, 2022

Related U.S. Application Data

(60) Provisional application No. 63/070,081, filed on Aug. 25, 2020.

(51) Int. Cl.

| | |
|---|---|
| ***B63B 21/06*** | (2006.01) |
| ***D07B 1/00*** | (2006.01) |
| ***D07B 1/02*** | (2006.01) |

(52) U.S. Cl.

CPC ..... *B63B 21/06* (2013.01); *D07B 1/00* (2013.01); *D07B 1/02* (2013.01); *D07B 2501/2061* (2013.01)

(58) Field of Classification Search

CPC .. D07B 7/169; D07B 1/24; D07B 2201/1014; D07B 2201/1096; D07B 2201/2045

(Continued)

(56) References Cited

U.S. PATENT DOCUMENTS 2,441,209 A 5/1948 Rose
3,183,658 A * 5/1965 Peterson et al. ..... H01B 17/22 57/22

(Continued)

FOREIGN PATENT DOCUMENTS

FR 1520698 A * 4/1968 ..... D07B 1/02
GB 319964 A * 10/1929 ..... D07B 1/02

(Continued)

OTHER PUBLICATIONS

International Searching Authority, ISA/KR; "Notification of Transmittal of the International Search Report and the Written Opinion of the International Searching Authority, or the Declaration" for International PCP App. No. PCT/US2013/0376614, dated Aug. 20, 2013.

*Primary Examiner* — Khoa D Huynh
*Assistant Examiner* — Grace Huang
(74) *Attorney, Agent, or Firm* — Sand, Sebolt & Wernow Co., LPA

(57) ABSTRACT

A mooring loop is operative to secure a movable device such as a ship in connection with a bollard or other fixed structure. The exemplary mooring loop includes a continuous rope segment that includes at least one coil or a plurality of coils. The rope segment defining the mooring loop includes an inner core surrounded by an outer jacket. A plurality of controlled failure points are included in the rope segment. The failure points enable the rope segment to permanently elongate in response to an applied tension force at a level above a working range, which elongation is visibly observable. The controlled failure point is defined between segmented ends of a severed inner core such that only the outer jacket is located at the controlled failure point.

18 Claims, 4 Drawing Sheets

(58) Field of Classification Search
USPC ..... 57/202, 22
See application file for complete search history.

(56) References Cited

U.S. PATENT DOCUMENTS

| | | | | | |
|---|---|---|---|---|---|
| 3,355,542 | A * | 11/1967 | Finn | H02G 7/056 | 174/79 |
| 3,837,156 | A * | 9/1974 | Langanke | D02G 1/0286 | 57/288 |
| 3,888,965 | A | 6/1975 | Kwolek | | |
| 3,968,725 | A | 7/1976 | Holzhauer | | |
| 4,001,367 | A | 1/1977 | Guthrie et al. | | |
| 4,170,921 | A * | 10/1979 | Repass | D04C 1/12 | 87/8 |
| 4,195,549 | A * | 4/1980 | Schuster | F16G 3/02 | 87/6 |
| 4,321,854 | A * | 3/1982 | Foote | D07B 1/04 | 87/8 |
| 4,343,343 | A | 8/1982 | Reuter | | |
| 4,412,474 | A * | 11/1983 | Hara | D04C 1/12 | 87/6 |
| 4,445,317 | A * | 5/1984 | Mima | B65H 69/063 | 57/22 |
| 4,446,944 | A | 5/1984 | Forrest et al. | | |
| 4,534,262 | A | 8/1985 | Swenson | | |
| 4,563,869 | A | 1/1986 | Stanton | | |
| 4,650,715 | A | 3/1987 | Voser | | |
| 4,677,818 | A * | 7/1987 | Honda | D07B 1/165 | 57/224 |
| 5,303,498 | A * | 4/1994 | Yutori | D07B 1/0693 | 43/44.98 |
| 5,398,634 | A | 3/1995 | Eagan | | |
| 6,257,163 | B1 | 7/2001 | Carpenter | | |
| 6,533,066 | B1 | 3/2003 | O'Dell | | |
| 7,461,500 | B2 | 12/2008 | Theis | | |
| 7,703,372 | B1 | 4/2010 | Shakespeare | | |
| 7,743,885 | B2 | 6/2010 | Martin et al. | | |
| 8,136,438 | B2 | 3/2012 | Shakespeare | | |
| 8,197,074 | B2 * | 6/2012 | Hurwitz | G02B 5/124 | 427/163.4 |
| 8,365,646 | B2 | 2/2013 | Fields | | |
| 8,448,555 | B2 * | 5/2013 | Dow | D07B 1/185 | 87/13 |
| 10,745,855 | B2 * | 8/2020 | Jessup | A61L 27/34 | |
| 11,181,169 | B2 * | 11/2021 | Wetzels | D04C 1/06 | |
| 11,229,432 | B2 * | 1/2022 | Coffey | D04C 1/12 | |
| 2003/0154802 | A1 | 8/2003 | Culshaw et al. | | |
| 2003/0197303 | A1 | 10/2003 | Chuah et al. | | |
| 2005/0039668 | A1 | 2/2005 | Sanford | | |
| 2005/0217748 | A1 | 10/2005 | Ikegami | | |
| 2008/0028740 | A1 | 2/2008 | Ushijima | | |
| 2010/0162882 | A1 | 7/2010 | Shakespeare | | |
| 2011/0239420 | A1 | 10/2011 | Abell | | |
| 2021/0362808 | A1 * | 11/2021 | Jahn | G01M 5/0025 | |

FOREIGN PATENT DOCUMENTS

| | | | | |
|---|---|---|---|---|
| GB | 2111012 | A | 6/1983 | |
| GB | 2265162 | A * | 9/1993 | B65H 69/02 |
| JP | 07-216769 | A | 8/1995 | |
| KR | 20110080010 | A * | 7/2011 | |
| KR | 200475026 | Y1 * | 11/2014 | D07B 1/02 |
| WO | 2013163094 | | 10/2013 | |
| WO | 2016089215 | | 6/2016 | |

* cited by examiner

CONTROLLED FAILURE POINT FOR A ROPE OR MOORING LOOP AND METHOD OF USE THEREOF

CROSS REFERENCE TO RELATED APPLICATIONS

This application claims the benefit of U.S. Provisional Application Ser. No. 63/070,081, filed on Aug. 25, 2020; the disclosure of which is incorporated herein by reference.

TECHNICAL FIELD

Exemplary arrangements relate to devices for securing a mooring line to a bollard or other fixed structure. The exemplary embodiments include a splice used to make a mooring loop that elongates in a controlled manner in response to applied force above a yield force and provides a visual indication of the need for replacement or reinforcement prior to separation failure. More particularly, the visual indication may occur at one or more dedicated or controlled failure points.

BACKGROUND

Mooring loops are used to connect mooring lines of ships or other movable items to fixed structures such as bollards. In the event that a mooring line is overloaded the line breaks and damage may be caused to the vessel or other secured item. Personal injury may result to persons in proximity to the line when it fails.

The inventor of the present application as previously developed a mooring loop that will reduce the risk of catastrophic failure by elongating and giving a visual indication that the mooring loop has been subject to a force above a yield force before separation. A mooring loop of this type is shown in U.S. Pat. No. 9,056,656 the disclosure of which is incorporated herein by reference in its entirety.

Mooring loops and similar securing structures manufactured from partially drawn or totally undrawn fibers may benefit from improvements in splicing techniques. Especially as they relate to the ultimate breaking strength of the mooring loop.

SUMMARY

Exemplary arrangements relate to mooring loops that may be selectively configured to provide controlled elongation when subject to a tensile force above a yield force. Exemplary mooring loops further provide a selectively variable amount of elongation based on the level of applied force above the yield force and the prior extent of elongation. Exemplary arrangements further provide a visual indication of the application of an excessive force prior to separation failure of the mooring loop. Exemplary rope constructions provide a selectively variable mooring loop breaking force at a controlled failure point be based on a ratio of the volume of the fiber in the rope jacket versus the volume of the core.

In one aspect, an exemplary embodiment of the present disclosure may provide a mooring loop is operative to secure a movable device such as a ship in connection with a bollard or other fixed structure. The exemplary mooring loop includes a continuous rope segment that includes at least one coil or a plurality of coils. The rope segment defining the mooring loop includes an inner core is surrounded by an outer jacket. A plurality of controlled failure points are included in the rope segment. The failure points enable the rope segment to permanently elongate in response to an applied tension force at a level above a working range, which elongation is visibly observable. The controlled failure point is defined between segmented ends of a severed inner core such that only the outer jacket is located at the controlled failure point.

In another aspect, an exemplary embodiment of the present disclosure may provide a mooring loop comprising: an outer jacket and an inner core defining a rope; a first controlled failure point in the rope defined by segmented ends of the inner core within the outer jacket, wherein there is only the outer jacket and there is no inner core in the rope at the first controlled failure point. This exemplary embodiment or another exemplary embodiment may further provide a ratio of volume of material of the outer jacket to volume of material of the inner core in a range from 1:1 to 8:1. In one particular example, the ratio is 4:1 (i.e., 80%-20%). This exemplary embodiment or another exemplary embodiment may further provide a splice connecting first and second ends of a rope to form a continuous loop. This exemplary embodiment or another exemplary embodiment may further provide a position of the first controlled failure point located a distance from the splice, wherein the distance of the first controlled failure point from the splice is greater than 25% of a length of the continuous loop. This exemplary embodiment or another exemplary embodiment may further provide a plurality of coils defined by the continuous loop, wherein the plurality of coils define first and second ends of the mooring loop; wherein the first controlled failure point is located between the first and second ends along one of the coils in the plurality of coils. In one example, the splice is located at one of the first and second ends of the mooring loop. This exemplary embodiment or another exemplary embodiment may further provide a yield strength of the first controlled failure point that is in a range of 50% to 90% a yield strength of the rope along a portion of the rope where the outer jacket surrounds the inner core. This exemplary embodiment or another exemplary embodiment may further provide a constriction zone at the first controlled failure point having a reduced diameter relative to a portion of the outer jacket surrounding the inner core when the rope is placed in tension. In one example, there is a constriction angle at a first segmented end of the inner core, wherein the constriction angle effectuates the outer jacket to engage the first segmented end of the inner core when the rope is placed in tension.

In yet another aspect, an exemplary embodiment may provide a method comprising: attaching a mooring loop having at least one coil to a fixed structure, wherein the mooring loop comprises an inner core and an outer jacket; attaching a mooring line to the mooring loop; effecting tension to be applied to the mooring loop by way of the mooring line; and stretching a controlled failure point in the mooring loop, wherein the controlled failure point is comprised of only the outer jacket; and at the controlled failure point the inner core is severed between segmented ends such that there is no inner core at the controlled failure point, wherein stretching the controlled failure point is adapted to provide a visual indication of a failure of the mooring loop. This exemplary embodiment or another exemplary embodiment may further provide defining first and second ends in the mooring loop; engaging one of the first and second ends of the mooring loop with the fixed structure; and positioning the controlled failure point between the first and second ends at a distance from the fixed structure such that the controlled failure point does not contact the fixed structure. This exemplary embodiment or another exemplary embodiment may further provide constricting the control failure point while the mooring loop is under tension to create a constriction zone at the controlled failure point; defining a constriction angle of the constriction zone relative to a longitudinal axis of a coil within which the controlled failure point is positioned; contacting the outer jacket with a first segmented end of the severed inner core; and contacting the outer jacket with a second segmented end of the severed inner core. This exemplary embodiment or another exemplary embodiment may further provide effecting the controlled failure point to have a yield strength less than a yield strength of the mooring loop at a location comprising both the outer jacket and inner core. In one example, the ratio is in a range from 1:1 (i.e., 50%-50%) to 8:1 (87.5%-12.5%). In one particular example, the ratio is about 4:1 (80%-20%). This exemplary embodiment or another exemplary embodiment may further provide effecting the yield strength at the controlled failure point to be less than a yield strength of the mooring line that is adapted to cause the controlled failure point to fail prior to catastrophic failure of the mooring line. This exemplary embodiment or another exemplary embodiment may further provide stretching a second controlled failure point in the mooring loop, wherein the second controlled failure point is located on an opposing side of the mooring loop from the first controlled failure point. This exemplary embodiment or another exemplary embodiment may further provide disposing of the mooring loop subsequent to stretching the controlled failure point that is indicative of mooring loop failure; and removing the mooring looping and selectively installing a second mooring loop onto the fixed structure to replace the mooring loop having failed and coupling the second mooring loop to the mooring line.

In yet another aspect, an exemplary embodiment of the present disclosure may provide a mooring system comprising: a bollard fixedly connected to a dock; a mooring line connected to a ship floating adjacent the dock; a mooring loop defining at least one coil that couples the mooring line to the bollard, wherein the mooring loop is formed from rope comprising an inner core and an outer jacket; wherein the mooring loop includes at least one controlled failure point defined at a portion of the rope where there is no inner core and only the outer jacket, and the at least one controlled failure point is positioned along the at least one coil a distance away from the bollard such that the at least one controlled failure point does not contact the bollard.

Numerous different arrangements and configurations of mooring loops may be made to suit particular load bearing needs, ultimate breaking force, and requirements based on the principles described herein.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
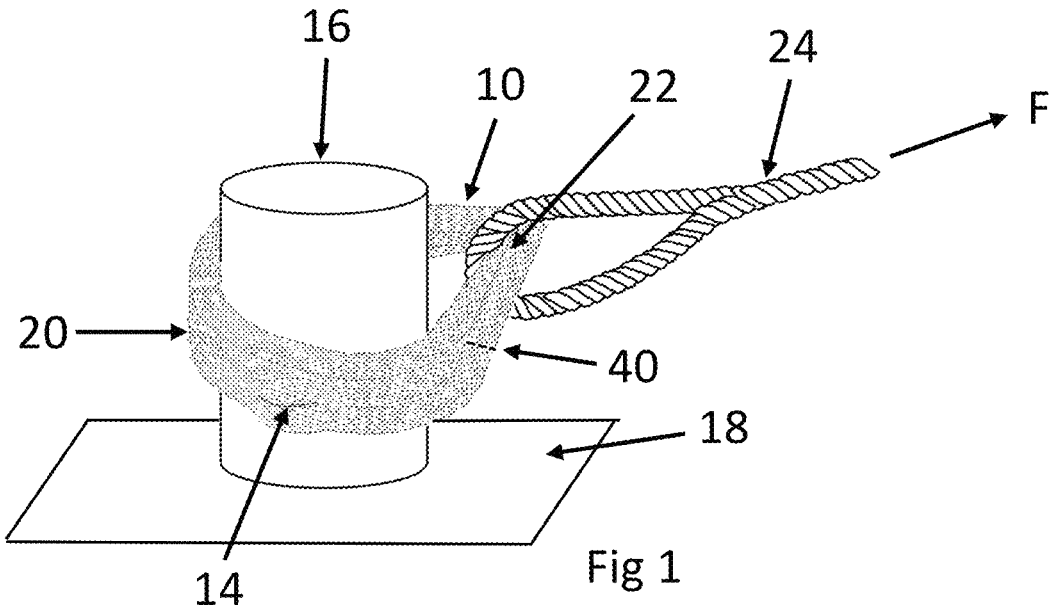
FIG. 1 is a perspective view showing an exemplary mooring loop in connection with a bollard and a mooring line of a ship or other movable vessel or apparatus.

FIG. 1 depicts an exemplary mooring loop generally at 10. The exemplary mooring loop 10 is comprised of a continuous length of rope 26 that includes a plurality of coils 12. The ends of the length of rope 26 are joined together at a splice 14 in a manner like that later discussed to form the continuous length of rope to defines loop 10. One end 20 of the exemplary mooring loop 10 is shown in engaged relation with a bollard 16. The bollard 16 is in fixed connection with a dock 18 or other fixed structure. An opposed end 22 of the mooring loop 10 is shown in engaged relation with a mooring line 24. The mooring line 24 is attached to a ship or other vessel, or other movable item. The mooring line 24 is subject to a tension force represented F which places the mooring loop 10 in tension.

Figure 2:
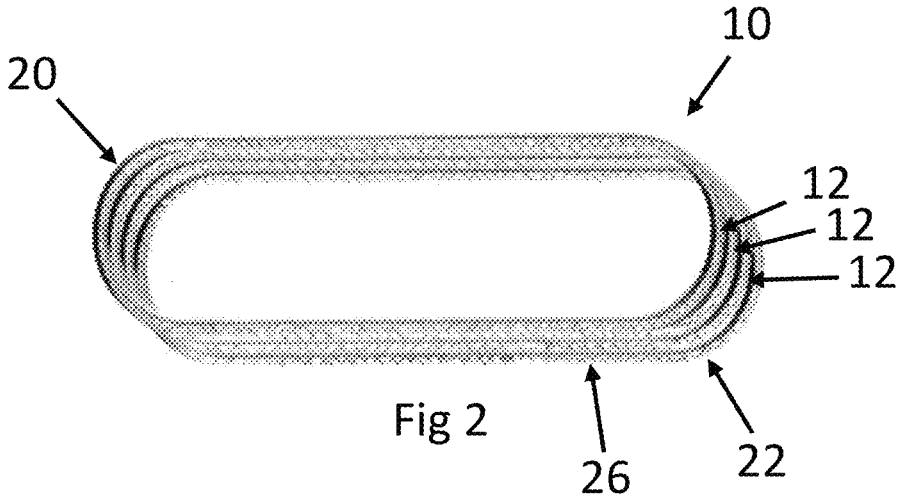
FIG. 2 is a top left perspective view of a mooring loop including a plurality of coils.

As shown in FIG. 2 the exemplary mooring loop 10 is comprised of the continuous length of rope 26 which may be alternatively referred to herein as a rope segment. The length of rope 26 is configured to provide sufficient length to form the plurality of coils 12 which may also be referred to herein as turns 12. The length of rope 26 is connected back to itself through the splice 14. Exemplary arrangements may have a rope segment length that provides a single coil 12 while other arrangements may have a plurality of coils 12. The number of coils 12 included in the mooring loop 10 may be determined by the yield and elongation properties that are desired for the particular application in which the mooring loop will be used. Further it should be understood that mooring loops including one or more coils may be used in combination. In some situations mooring loops may be used in parallel such that a plurality of mooring loops extend between a bollard or other fixed support and a single mooring line. However in other arrangements mooring loops may be used in series to provide desired yield and elongation properties.

Figure 3:
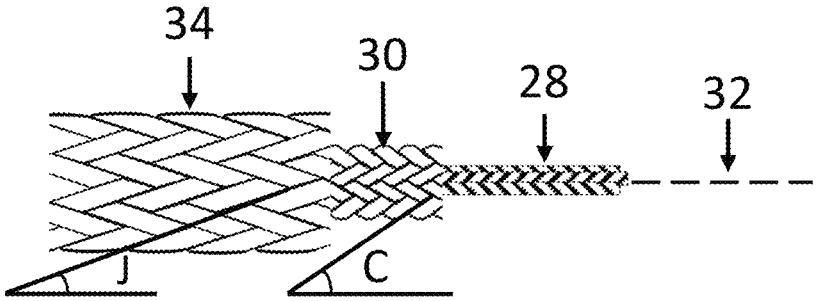
FIG. 3 is a perspective view of an exemplary rope segment used in an exemplary mooring loop section expanded to show the layers therein and indicate the braid angles thereof.

FIG. 3 shows an exemplary length of rope 26 that has been shown selectively radially severed in different locations to show the different internal components which make up the rope segment. The exemplary rope is comprised of a plurality of center yarns 28. In the exemplary arrangement each of the center yarns is comprised of polypropylene fibers. The exemplary center yarn 28 fiber provides elongation of about 700% without separation. As used herein the word about shall be deemed to include the value indicated as well as a range from the indicated value plus or minus 500% so long as the core is equal to or more than the outer jacket. The exemplary center yarn fiber also elongates responsive to tensile force above a yield point and takes on a permanent set. In the exemplary arrangement each center yarn includes about 144 filament strands of 4000 denier fibers. In the exemplary arrangement the center yarns are comprised of 3, 4 or 5 center yarns each including eleven ends exposed in a transverse section for a total yarn denier of 44,000 in the exemplary arrangement. Notably, FIG. 3 depicts the example of having three center yarns 28, but it is to be understood that four or five center yarns, or more are possible. Each of the center yarns 28 in the exemplary arrangement has an S direction twist.

Each center yarn 28 is twisted in a range between 0.5 turns per inch and 1.25 turns per inch along the axial direction of the yarn. In the exemplary arrangement each center yarn is twisted at about 1 turn per inch in the S direction. In some exemplary arrangements the center yarns may be comprised of polypropylene fiber, Type TI 62-1626 4000 denier/144 filament which is commercially available from Fiber Innovation Technologies. Of course it should be understood that this material and configuration is exemplary and in other arrangements other materials and configurations may be used.

The exemplary length of rope further includes a braided core or inner core 30. The core 30 extends in radially outwardly overlying relation of the center yarns 28 or center fibers. The exemplary inner core 30 is comprised of about 150% elongation polyester fiber. The exemplary braided core 30 is comprised of twenty-four ends of 700 denier yarn for total yarn denier of 16,800. In some exemplary arrangements, the 150% elongation polyester fiber may be a type 1KE45-132C, 700 denier, 144 filament polyester fiber material that is commercially available from the Providence Yarn Company. Of course, the use of this material is exemplary and in other arrangements other materials may be used.

In the exemplary arrangement, each yarn, which is included in the core 30, is twisted in the S direction. Each yarn of core 30 is twisted in a range of 0.25 turns per inch to 1.25 turns per inch. In the exemplary arrangement each of the yarns in the core is twisted at about 0.75 turns per inch in the S direction. Of course it should be understood that this configuration is exemplary and in other arrangements other twist configurations may be used.

With continued reference to FIG. 3, the exemplary core 30 is comprised of the 150% elongation polyester yarns having a braid angle C relative to the central longitudinal axis 32 of the rope segment. The angle C is in a range of 30° to 60°. In the exemplary arrangement shown the angle C is about 45°. As later discussed other exemplary arrangements may include a plurality of braided core structures comprised of different materials and braid angles depending on the particular desired properties of the particular mooring loop.

In the exemplary arrangement the rope segment of which the mooring loop is comprised includes an outer jacket 34. In the exemplary arrangement the outer jacket is comprised of a braided 150% elongation fiber of the type used for the braided core 30. The exemplary yarn of the jacket 34 is comprised of ninety-six ends of 700 denier polyester yarn for total yarn denier of 67,200. Of course it should be understood that this material is exemplary and in other arrangements other material may be used.

Further in the exemplary arrangement each yarn of the jacket has an S direction twist. The S direction twist is in the range of about 0.15 turns per inch to about 1.0 turns per inch. The exemplary embodiment includes an S direction twist for each yarn at about 0.5 turns per inch. Of course it should be understood that this configuration is exemplary.

With continued reference to FIG. 3, the outer jacket 34 has a braid angle J in a range from about 15° to about 45° relative to the rope segment axis 32. In the exemplary arrangement the braid angle of the jacket 34 is about 30°. Of course it should be understood that this configuration is exemplary and in other arrangements other approaches may be used. In one particular example, it is beneficial for braid angle J of the outer jacket 34 to be less than the braid angle C of the inner core 30. For example, when the braid angle C of inner core 30 is about 45 degrees, the braid angle J of the outer jacket 34 is about 30 degrees relative to longitudinal axis 32.

In the exemplary embodiment of the rope segment used in the mooring loop 10, the outer jacket 34 is configured to provide about 80% of the total load bearing strength of the rope. The core 30 is configured to provide about 20% of the total load bearing strength of the rope. Further as previously discussed, in the exemplary arrangement all yarns included in the braided core and the braided jacket are all twisted in the same twist direction. As a result when the braid of each of the core 30 and the jacket 34 are formed on a braiding machine, half of the yarns have their twists tightened while the other half have their twists untwisted or loosened as a result of the braiding process. The yarns that are untwisted or loosened in the braiding process are more parallel relative to the axis 32 and will begin to elongate earlier with increased loading, with elongation commencing at a force that is above a yield point for the plurality of parallel fibers. The more twisted fibers will not begin to elongate at the same time the level of force is applied that causes the less twisted fibers to permanently elongate. In the exemplary arrangement this results in the less twisted fibers elongating and then breaking earlier and at an overall loading force lower than fibers that are more twisted. As a result the fibers in the jacket 34 and core 30 reach maximum elongation and break at different times under loads above the yield force, which along with the center yarns which provide a much greater degree of elongation prior to separation, avoids breakage which results in separation of the rope segment.

In addition it should be appreciated that in the exemplary arrangement the outer jacket 34 has a lower braid angle J for the yarns therein than the braid angle C of yarns that are included in the core 30. As a result yarns included in the jacket 34 are closer to the direction parallel to the axis 32, and start to yield and elongate sooner than the fibers in the yarns which comprise the core. This is because the higher braid angle C in the core 30 does not untwist and become parallel to the axis 32 as quickly as the applied tensile force rises. As a result of the lower braid angle J in the jacket 34, the fibers in the jacket elongate first and will fail through separation before the braided fibers in the core 30. In the exemplary arrangement the core 30 fibers stay intact during loading above the initial yield point to stretch and dissipate tension.

Of course it should be understood that these configurations which provide the force loading resistance and elongation capabilities of the exemplary rope arrangement are but one of numerous arrangements that may be provided in a rope segment that is used to form a mooring loop 10, and in other arrangements other configurations may be utilized to provide different force resistance and elongation properties.

Figure 4:
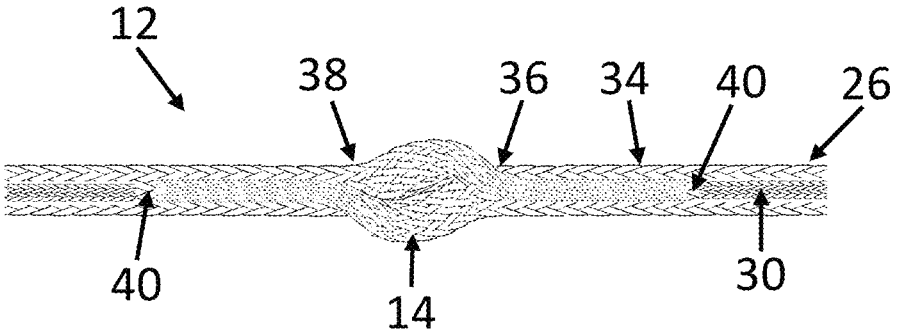
FIG. 4 shows an exemplary splice formed in a rope segment to provide a continuous mooring loop with a controlled failure point included on each transverse side of a splice.

FIG. 4 depicts the formation and configuration of exemplary splice 14 that is used in the exemplary arrangement to form the continuous rope length 26 of the mooring loop 10. In the exemplary arrangement end portions 36 and 38 of the rope are arranged in abutting adjacent relation. The outer jacket 34 on each end portion is tucked back into itself. In the formation of the splice 14, the jacket 34 of the end portion 36 is inserted into the jacket 34 of the end portion 38. The jacket 34 of the end portion 38 is inserted into the jacket 34 of the jacket of the end portion 36. Such insertion is used to form a crossover end to end tuck splice 14. This tuck splice joins the jackets of the end portions 36 and 38. However in the exemplary arrangements the braided core portions 30 underlying the spliced jacket portions remain separate. The separation or gap in the core 30 that underlies the splice 14 provides one potential controlled failure point in the exemplary arrangement which may operate in conjunction with other controlled failure points 40 which are later discussed.

In the exemplary arrangement the splice 14 of the mooring loop is preferably positioned at end in abutting engagement with the bollard 16 during operation. This arrangement facilitates the generally uniform application of tensile force on the jacket 34 on each axial side of the splice. Of course it should be understood that this configuration during use of the mooring loop 10 is exemplary and for other mooring loop structure arrangements other configurations and orientations may be utilized during use.

Figure 5:
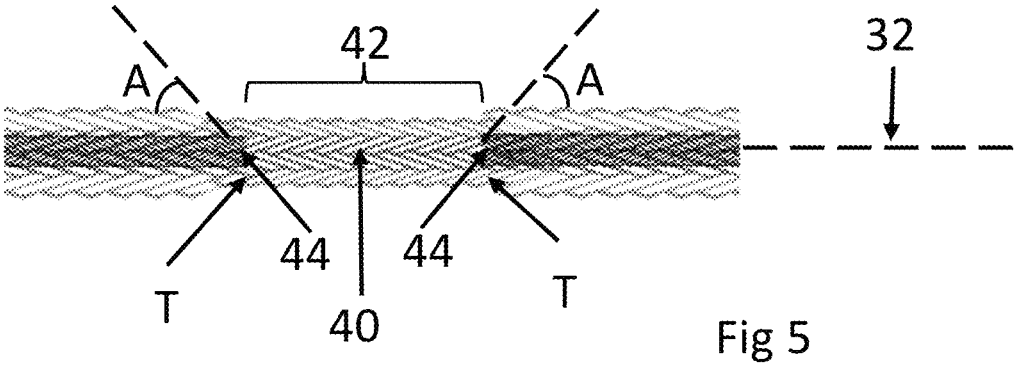
FIG. 5 is an operational side cross-sectional view of a portion of the mooring loop including a controlled failure point when the outer jacket has been elongated due to a load above a yield point.

As depicted in FIG. 4 and FIG. 5, the exemplary length of rope 26 which is included in the mooring loop 10 includes at least one controlled failure point 40. In the exemplary arrangement a failure point 40 is formed by severing the core 30 and the center yarns 28 within the rope segment 26. In this exemplary arrangement the braided yarns which are included in the outer jacket 34 remain continuous and non-severed. The exemplary controlled failure point 40 provides an area in the length of rope 26 in which the core 30 does not initially provide resistance to applied tensile force on the rope. Rather, in the area of controlled failure point 40 the force applied to the length of rope in the mooring loop is resisted and carried entirely by the braided outer jacket 34. As a result when force is applied to the length of rope 26 which is above a level at which the jacket begins to yield, the jacket will initially elongate and the core 30 will not operate to resist such elongation. As a result of this exemplary configuration, the length of rope will begin to yield and elongate at a force that is lower than the force which would cause the rope to yield and elongate if both the core 30 and the overlying jacket 34 were continuous.

In an exemplary arrangement a pair of controlled failure points 40 are positioned in the coil 12 of the length of rope that includes the splice 14. In this exemplary arrangement the failure points 40 are positioned an equal distance away from the splice 14 and on opposed lateral sides of the splice 14. In the exemplary arrangement each of the failure points 40 are positioned a distance along the central axis of the rope so that generally the failure points 40 will be positioned in a portion of the rope that extend in about parallel relation when the splice 14 on the end 20 of the loop is in engagement with the bollard 16 and the opposed end 22 of the loop is engaged with the mooring line 24 or other load. This is represented by the failure point 40 as shown in phantom in FIG. 1.

When the loop 10 is arranged with a plurality of coils, the overall length of the loop 10 is defined by a linear distance from end 20 to end 22. To provide a sufficient amount of clearance from bollard 16, one exemplary embodiment positions the controlled failure point a certain distance from the end that engages the bollard 16. For example, if first end 20 is engaging the bollard as shown in FIG. 1, then the controlled failure point 40 may be positioned a distance that is greater than 25% the length of the loop (measured between end 20 and end 22) from the first end 20. As shown in FIG. 1, this ensures that the controlled failure point 40 is spaced from the bollard 16 when placed in tension. This allows the operator a proper visual inspection and ensures that frictional interference forces with the bollard do not disrupt the operation of the controlled failure point. In the exemplary arrangement disposing the failure points a sufficient distance from the splice 14 helps to assure that the outer jacket 34 in overlying relation of the respective failure point 40 will not be in compressed engaged relation with the outer surface of the bollard. This helps to assure that outer jacket overlying at least one of the failure points 40 will begin to elongate when the rope in the coil is subject to tensile force at the level above the yield force of the jacket. Of course this approach is exemplary and in other arrangements other approaches may be used such as those that are later discussed.

FIG. 5 depicts an exemplary arrangement wherein the elongation of the outer jacket 34 in overlying relation of the failure point 40 is operative to cause formation of a constriction area 42 between the severed core ends 44. In the exemplary arrangement the construction area in the outer jacket 34 that results from elongation, is operative to cause the transverse ends that bound the constriction area 42 to apply a radially inwardly directed constriction force represented T to the each severed core end 44 and a portion of the core 30 immediately adjacent thereto. This results due to the braided outer jacket in the constriction area having a smaller inside diameter and tightening onto and firmly engaging the core 30 adjacent severed core ends. This tightening and firm engagement with core 30 adjacent the severed ends of the core 30 that occurs after the extent of elongation of the outer jacket 34 in the constriction area 42, results in the core 30 becoming firmly engaged with the jacket on each lateral side of the constriction area 42. As a result further elongation of the rope segment beyond the length at which the core 30 adjacent severed core ends 44 are fixedly engaged by the constricted jacket is resisted by the strength of the core. As a result further elongation in the area of the failure point in response to increasing force is resisted in a controlled manner based on the properties of the jacket at the constricted level of elongation and the properties of braided core 30. Further as can be appreciated in exemplary arrangements the initial gap length between the severed ends of the core may be used to control the extent of elongation and the level of applied force which is resisted before the constricted area of the jacket tightens and re-engages with the core ends. As a result the selective elongation and force resistance properties may be selectively controlled.

In exemplary arrangements when the mooring loop 10 is in use, and the loop includes more than one coil, the tension force F will first cause the coils to become taut. Applied force which increases to above the normal working range to a level at which the jacket 34 will begin to elongate in the area of the controlled failure point 40, will then cause permanent elongation of the fibers of the jacket 34. The elongation will cause the coils to begin unwinding until constriction of the jacket causes core re-engagement in the area of the controlled failure point or otherwise the resistance to elongation begins to rise. This will cause elongation to begin at the other controlled failure point. The properties in the exemplary arrangement, that the applied force which causes the fibers which comprise the jacket of the loop to elongate is lower than a force at which the loop would break and separate, prevents a single instantaneous break when the loop is pulled to a point of final separation.

In exemplary arrangements the center yarns of the exemplary arrangement which have a much higher capability for elongation before breakage also enables the dissipation of force which reduces the risk of an instantaneous separation break. The construction which includes the numerous controlled failure points and elongation capabilities also causes the exemplary mooring loop to visually indicate when it is subject to a force level at which yield is occurring. The indication that the mooring loop has elongated enables the user to take steps to reinforce the engagement between the vessel or other movable apparatus, and the bollard or other stationary structure through use of another mooring loop, additional lines or other securing methods while the mooring loop is still within the range for safe elongation and prior to any separation failure occurring. In some exemplary arrangements suitable coloration, markings, applied visible indicia, attached indicators, sensors or other approaches may be utilized to give a visual indication or other type indication that the mooring loop is or has been subject to elongation due to application of the force above a set level. In addition it should be understood that the area of the rope segment adjacent to the ends 20, 22 may have an overlying sheath, protective layer, or other covering to minimize abrasion due to moving contact with the bollard, mooring line or other engaged structure. Numerous different approaches may be employed for these purposes.

Having thus described the various features of the mooring loop 10 or rope segment, additional advantages are referred to herein. Traditionally, a double braided rope has one strand of fibers braided with another braid of fibers. Double braided ropes are typical high performance rope for mooring and other purposes. To obtain the maximum strength out of the rope, a rope engineer or designer will often try to balance the strength of the core 30 with the strength of the jacket 34. Typically, there is about 50 percent of the strength in each of the components. Stated otherwise, about 50 percent of the rope's strength comes from the jacket 34 and about 50 percent of the rope's strength comes from core 30. For example, if the rope will break at four tons, then two tons of strength is imparted by the strength of core and two tons of strength is imparted by the jacket. The 50-50 split of jacket to core strength is common in rope to maximize strength and is a common design. The present disclosure deviates from this common design.

The present disclosure utilizes the controlled failure points to purposely create a weaker section of rope that utilizes a different volume ratio of jacket to core to purposely create the weakened sections or failure points 40 that will act as an indicator for the mooring loop or rope segment to identify its failure prior to a catastrophic breakage. The present disclosure discloses the rope segment that fails at a weaker point than it would normally break. The present disclosure uses a volume ratio that is unbalanced (i.e. not 50-50). Particularly, the ratio of the volume of fiber in the rope jacket to the volume of fiber in the core is greater than 50-50 (i.e., 1:1). In one particular example, the volume of fiber in the rope jacket to the volume of fiber in the core is about 80% to 20% percent (i.e., 4:1). Other ratios are possible that provide a greater amount of the volume of fiber in the rope jacket relative to the volume of fiber in the core. For example, the ratio may be 55% to 45% (11:9), or 60% to 40% (i.e., 3:2), or 65% to 35% (i.e., 13:7), or 70% to 30% (i.e., 7:3), or 75% to 25% (3:1), or 85% to 15% (i.e., 17:3), or 90% to 10% (i.e., 9:1). When a ratio of the volume of fiber in the rope jacket 34 to the volume of fiber in the core is 80% to 20% (i.e., 4:1), a conventional assumption would be that the rope segment would simply be 80% strength than that of a rope that did not include the purposeful cut or segmented core defined by the severed core ends 44. However, one exemplary unique aspect of the present disclosure is that the outer jacket 34 material is made from fibers that stretch with unique properties and are distinct and different from traditional rope fibers that do not stretch and in which the traditional fibers are strong initially but then yield to failure relatively quickly (i.e. snap and break). To the contrary, the jacket 34 is made from fibers that have linear elongation or stretch that allow the outer jacket material having a greater volume ratio than that of the inner core to stretch and constrict onto the severed ends 44 to create the constriction zone 42 to effectively pinch and secure the severed ends 44 to thereby create the constricted section of rope 42 that has a strength equal to 80% of a standard rope.

If the core 30 is cut or severed to define the severed ends 44, the jacket 34, based on the construction with the linear elongated fibers, is able to cinch onto the core, when under tension F, to grasp the severed ends 44 of core 30 and hold the core 30 to provide sufficient strength or constriction force T through the remainder of the rope up to the point where the jacket will break or fail. In one example, when the volume of the material of the core 30 is at 20% and the volume of material of the jacket 34 is at 80%, the rope will only have about 80% of its strength at the constriction zone 42 that defines the purposeful controlled failure point 40. Any other location of the rope not defined by a constriction zone 42, the rope will have 100% of its strength so long as there is not another controlled failure point at the observed location. While traditional thinking would believe that this would be a detriment because the rope is being purposely weakened, an advantage of the present disclosure is able to overcome this traditional belief of weakening the rope as insufficient. Particularly, the jacket 34 is made from a material that stretches or otherwise linearly elongates, which allows the rope manufacturer to benefit and purposefully design a characteristic of the rope that may be exploited and utilized in new ways. Namely, because the fibers of the outer jacket 34 stretch or linearly elongate when under tension F, the rope is attempting to achieve an elongated section under constant tension (the flat portion of the curve shown in FIG. 8-FIG. 9). The fibers operate in a manner based on their denier. The rope of the present disclosure desires to cause the outer jacket 34 of the rope to stretch at a yield point a then linearly elongate under constant tension F.

Take for example a rope that has a denier of one million. The one million denier rope, when subjected to a load or tension, will stretch, for example, out to one ton of force. The exemplary rope is agnostic or otherwise does not care which amount of force is being carried by the jacket 34 or the core 30. While this would matter and be of importance in a traditional rope, this is of no consequence to the rope of the present disclosure because it will still stretch at one ton of force as long as the force is still in the flat portion of the response curve (FIG. 8-9) where all the yarns are yielding and stretching. Because this is the area where the rope of the present disclosure should perform, this provides a great advantage to the rope manufacturer. Thus, in the example, so long as the rope manufacturer has one million denier that is all stretching, the rope will perform in the desired manner. However, a problem arises when the rope of the present disclosure, when embodied as a mooring loop 10, is pulled past the useable length, which defines a replacement length, such as three meters because the flat part of the curve (FIG. 8-9) has been elongated to a point that it can no longer be stretched. In this instance, the mooring loop 10 must be replaced for a second mooring loop that has not been stretched out past its useable life.

Figure 6:
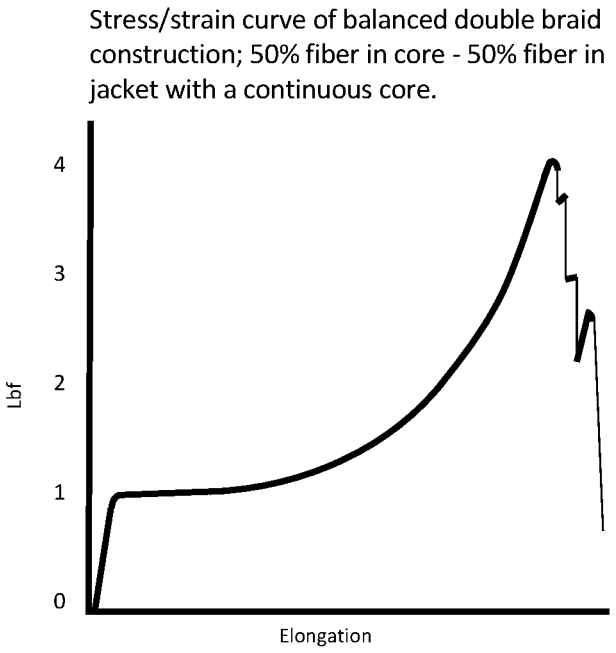
Fig 6 PRIOR ART
FIG. 6 (FIG. 6) is a graph depicting a stress/strain curve of a PRIOR ART rope having a balanced 1:1 (50%-50%) ratio of volume of material in the outer jacket to volume of material in the inner core, wherein the vertical axis represents the exemplary pound-force (lbf) and the horizontal axis represents elongation.

More particularly, FIG. 6 depicts a graph depicting a stress/strain curve of a conventional rope having a balanced 1:1 (50%-50%) ratio of volume of material in the outer jacket to volume of material in the inner core and wherein the inner core is continuous (i.e., non-severed), unlike the present disclosure. The vertical axis represents the exemplary pound-force (lbf) and the horizontal axis represents elongation. As seen in the curve of FIG. 6, when the rope is subjected to around 1 lbf, the rope will linearly elongate. Thereafter, as pound-force lbf increases, the elongation does not increase as quickly, resulting in the curve rising upward as pound-force (lbf) increases but elongation does not increase as steeply. In this exemplary instantiation, the break point or ultimate yield point is at 4 lbf, wherein subsequent to the yield the curve drops off representing a failure in the rope.

Figure 7:
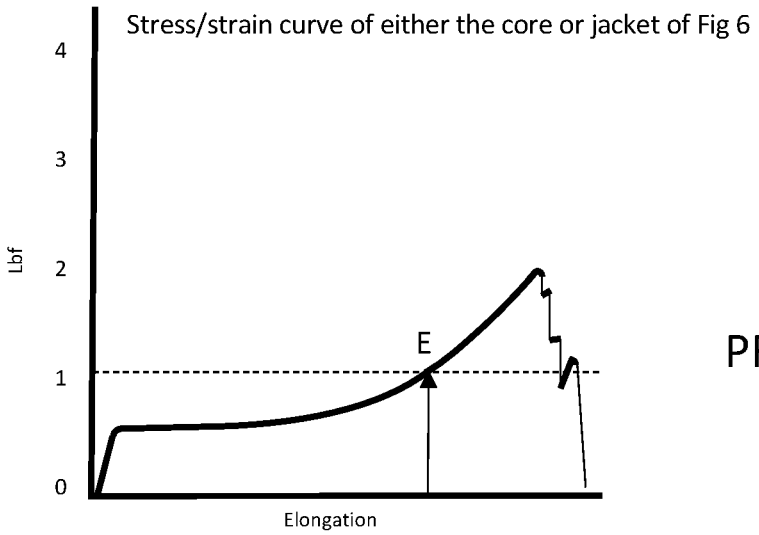
Fig 7 PRIOR ART
FIG. 7 (FIG. 7) is a graph depicting a stress/strain curve either the outer jacket or inner core from the PRIOR ART rope of FIG. 6 since the ratio is 1:1.

FIG. 7 depicts a graph depicting a stress/strain curve either the outer jacket or inner core from the conventional rope of FIG. 6 since the ratio is 1:1. With respect to the exemplary curve shown in FIG. 6, the break point or ultimate yield point of a balanced double braid with continuous core (i.e, not containing the controlled failure point) equals the maximum breaking force, which in this example is shown at 4 lbf. FIG. 7 is a curve but with only respect to either the outer jacket or the inner core for the rope depicted in FIG. 6. As shown in FIG. 7, the elongation of the outer jacket or inner core begins to elongate at 0.5 lbf because the ratio of outer jacket to inner core is 1:1 (50%-50%). The ultimate yield or break point of the outer jacket or inner core is at 2 lbf, which makes sense inasmuch as the total rope strength is 4 lbf when the ratio of outer jacket to inner core is 1:1 (50%-50%). Stated otherwise, each of the ratio of outer jacket to inner core has the ½ responsibility for establishing the total strength of the rope.

Figure 8:
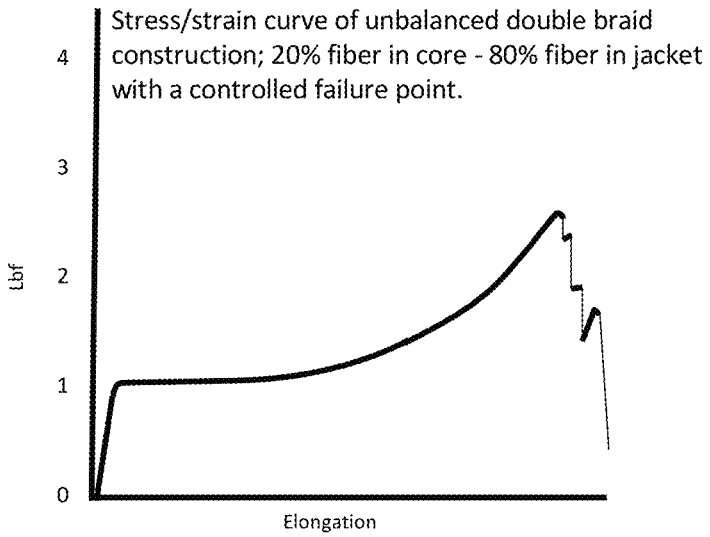
FIG. 8 is a graph depicting a stress/strain curve of a rope having an unbalanced 4:1 (80%-20%) ratio of volume of material in the outer jacket to volume of material in the inner core and at least one controlled failure point, wherein the vertical axis represents the exemplary pound-force (lbf) and the horizontal axis represents elongation.
Figure 9:
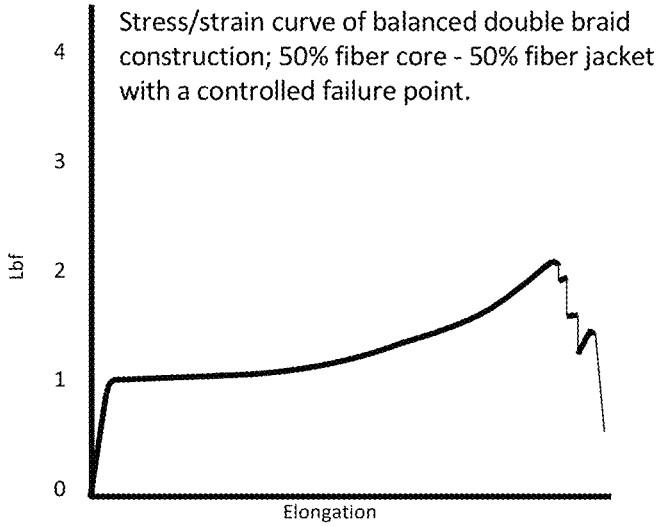
FIG. 9 is a graph depicting a stress/strain curve of a rope having a balanced 1:1 (50%-50%) ratio of volume of material in the outer jacket to volume of material in the inner core and at least one controlled failure point, wherein the vertical axis represents the exemplary pound-force (lbf) and the horizontal axis represents elongation.

FIGS. 8-9 depict a variety of performance response curves of exemplary rope 26 forming mooring loop 10 according to the present disclosure. FIG. 8 is a graph depicting a stress/strain curve of a rope 26 formed as mooring loop 10 having an unbalanced 4:1 (80%-20%) ratio of volume of material in the outer jacket to volume of material in the inner core and at least one controlled failure point 40, wherein the vertical axis represents the exemplary pound-force (lbf) and the horizontal axis represents elongation. With respect to the exemplary curve of FIG. 8, if the ratio is 20% core and 80% jacket and if the strength at yield is given a value of 1 lbf then the increase above the strength at yield to break is an additional 1.5 lbf for a total expected break or ultimate yield point of 2.5 lbf.

FIG. 9 depicts the stress/strain curve of a rope 26 formed as mooring loop 10 having a balanced 1:1 (50%-50%) ratio of volume of material in the outer jacket to volume of material in the inner core and at least one controlled failure point 40, wherein the vertical axis represents the exemplary pound-force (lbf) and the horizontal axis represents elongation. Since the ratio is 50% core and 50% jacket, then it is expected that the maximum break would be no higher than the break of just the jacket FIG. 7, which in this example is 2 lbf.

Returning to the previous example, assume the rope has one million denier. If a tension force pulls at 1,000 pounds, the rope will get stronger as it is pulled or put under tension because the molecular structure will align. Effectively, the rope is strengthened similar to a manner in which ropes are manufactured. Effectively, real world operation and application of the rope of the present disclosure accomplishes similar advantages as what are done when making the yarn in a fiber factory. The polymer effects the total strength of the rope and whether the molecules are fully aligned or oriented when drawn all the way out. For example, assume a normal polyester that is undrawn has a strength at yield of one-half gram per denier. By the time it is pulled all the way out, the total strength at tenacity may be three grams per denier. However, the present disclosure has found it advantageous to provide more strength when the rope segment embodied as a mooring loop starts to stretch. The present disclosure uses this unique advantage to take the fiber that begins to stretch at one half gram per denier and ultimately yields or breaks at three grams per denier and stretch it out part way in the fiber plant where it has been pulled and oriented that it will begin to stretch at one gram per denier and break at 3 grams per denier. Depending on the polymer that is used, which one exemplary of which is a polyester polymer, if it is stretching at one gram per denier and breaking at three grams per denier, then it is pulled all the way out, then the break point will be three times that amount. Thus, with this example, if the mooring loop is rated for 20 tons, when it is pulled all the way out, the break point will be three times that or 60 tons. A mooring line that has been used for about a year might only have 75 tons of strength left in it after use for a year from overloading. Thus, since the lines get weaker and weaker over time, the purpose of the mooring loop acts as a fuse to ensure that the tension on the mooring line never exceeds a certain point or tension which ultimately causes the mooring loop to fail before the failure of the mooring line.

The rope, when embodied as a mooring loop, gets stronger under tension which acts as a safety advantage. This is advantageous because if an operator were to be in a critical situation where it does not let go or does not get weaker, then the mooring line may break before the rope segment mooring loop acting as a fuse would break. Thus there is a technical advantage if the breaking point of the mooring loop is less than that of the mooring line. Stated otherwise, there is a technical advantage when an operator can engineer the breaking point of the mooring loop to be lower and closer to the stretch point of the material. Thus, the combination and arrangement of the purpose or dedicated controlled failure point 40 is able to achieve. Effectively, the cut or severed core 30 defined by severed or segmented ends 44 with the greater ratio of jacket material to core material enables the breaking point of the mooring loop to be closer to that of the stretch point rather than the ultimate failure. For example, when 80% of the strength is in the outside jacket 34 and only 20% of the strength is in the core 30, the outside jacket will constrict at the severed ends 44 onto the ends of the core 30 to define the constriction zone 42 defined by constriction angle A relative to the axis 32 of the rope. In one particular embodiment, the constriction angle A is less than or equal to 45 degrees. This allows a designer or engineer to design or fabricate a mooring loop that will allow the jacket 34 to constrict onto the core 30 that will provide a rope that will begin to stretch at two pounds per denier and fail at eight pounds per denier. When the core is severed, the outside jacket 34 will continue to stretch because it is under tension at an amount of one pound per denier until the force reaches two pounds per denier. Once the force gets to two pounds per denier, that is the point where the core and the jacket are equal and at that point, the jacket will start to cinch down and constrict onto the core at the constriction angle A. The outer jacket 34 grabs/cinches the core 30 until it reaches the breaking or yield point that will be defined by the ratio of the volume of the fiber of the outer jacket to the volume of the fiber of the core. Thus, when the ratio is 80% to 20% (i.e., 4:1), the breakpoint would be at 6.5 pounds per denier, which is 80% of the eight pounds per denier failure point of a rope that would be entirely formed of a core and jacket without any severed sections defining a purposeful control failure point 40.

Thus, the idea of severing the core 30 is an advantageous aspect of the present disclosure different than that which has been previously developed. Further, the ratio may be any ratio to allow a designer to purposely engineer a lower failure point to an amount lower than the failure point of the mooring line connected to the mooring loop. So long as the strength of the jacket is above the stretch point of the core, there is a sufficient amount of outside force to pinch on the core to bring the core and jacket back together at the constriction zone 42 to handle the load. Exemplary calculations indicate that is possible for the ratio of the volume of material composing the outer jacket to the volume of material composing the inner core to be as low as 20%-80% (1:4). Anything lower than this ratio may not enable the outer jacket to impinge or constrict sufficiently to grasp/cinch the core 30. Practically however, the ratio of the volume of the fiber of the jacket relative to the ratio of the volume of the fiber of the core is likely greater than or equal to 50-50 and likely less than about 95%-5% (19:1). This allows the operator or a designer to purposely engineer a breakpoint to match up with other needs such as the winch pull of the vessel or some other safety break that is set in the line so that the mooring loop does not break too low for another safety feature or requirement but still breaks low enough that it does not have as much energy as it would if there was no purposeful failure point 40 in the mooring loop 10. Thus, the controlled failure point 40 allows one to engineer the final breakpoint without infringing or impinging on the stretch performance of the whole rope segment coiled as a mooring loop 10 based on the ratio of the volume of fiber in the jacket to the volume of fiber in the core. This disclosure deviates from traditional thinking that would typically try to make ropes as strong as possible not purposefully weakening them at designated points and utilizing that weakness as an advantage or new or useful methodology or instantiation.

For the examples of the present disclosure, one exemplary advantageous interest lies with the ability to take advantage of the strength at yield and elongation such that it is desired to obtain 100 percent of the strength at yield and still be able to adjust the final breakpoint, then the designer or manufacturer of the mooring loop can create a safer mooring loop or "fuse" because the total fuse or mooring loop will come apart at a lower tension point. To further expand on this advantage, the mooring loop may be coiled around the bollard 16 and populated with multiple dedicated or purposeful failure points 40 and there was at least one failure point 40 in every coil of the loop 10 or at least every other coil of the loop 10, then the loop 10 would fail at the dedicated failure points 40 first. This would allow the mooring loop to break and the mooring loop would try to uncoil itself relative to the bollard 16. That would effectively cause its failure to simply fall from the bollard 16 and cause no significant detriment or risk of harm to individuals standing nearby such that snapback is effectively reduced or even eliminated.

Other advantages of the rope of the present disclosure include an unbalanced twist in the rope. The unbalanced twist assembly of the rope creates additional micro failure points. So when there are two twists, one clockwise and one counterclockwise, when they are braided together they reinforce each other and the whole rope is balanced so that it has no twist or torque. Thus, as the rope is braided, it tightens in one direction but loosens the other. Thus, in every layer of the jacket, there are fibers that are parallel and nonparallel. This requires that portions of the rope to straighten out to become parallel to the linear axis of the rope before the material begins to stretch. Thus, if some fibers are tightening and some fibers are loosening during the braiding process, there are some fibers that are more parallel and some fibers that are less parallel, thus there are two different break levels that are created in every layer of rope that is manufactured.

Numerous alternative structures and arrangements may also be utilized to produce a mooring loop that provides the ability to yield and elongate at a set level of tension force. This capability may be achieved in twisted, single braid, double braid or other forms of rope segments. In addition as previously discussed, securing arrangements that include multiple separate mooring loops each having single coils, or loops having different numbers coils may be utilized in parallel or in series to provide the desired securing properties and safe control of forces above a set level.

In other exemplary arrangements large variations in the yarn twist can increase the number of separation points as part of a cascading failure mechanism and reduce the need for the inclusion of other controlled failure points. Likewise variations in the center yarns and core yarns can be used to create mooring loops with fibers that separate at desired levels of elongation in response to a set level of applied force. For example instead of having a single core, alternative arrangements may have a plurality of braided cores in adjacent relation that are over braided by an outer jacket. Each core can have a different braid angle ranging from about 10° to 50°. In exemplary arrangements due to the different braid angles and the level of tensile force at which the fibers become parallel to the direction of the force, elongate and eventually break, different areas of breakage can be caused to occur in response to different levels of applied force which results in different amounts of elongation in different areas of the rope segment.

In other exemplary arrangements, controlled failure points can be incorporated into components of the mooring loop other than by severing the core and center yarns. For example in some arrangements failure points may be incorporated by periodically along the length of the rope segment, severing some but not all of the yarns in the braided core. In other exemplary arrangements, controlled failure points may be incorporated by severing one or more yarns in the braided outer jacket. In some arrangements the yarns may be severed periodically at regular intervals along the length of the rope. Further in some exemplary arrangements a subset of the yarns in the core and a subset of yarns in the jacket may be severed in different longitudinal and/or circumferential locations at regular periodic intervals. Such numerous different controlled failure points may be operative to create a plurality of disposed failure points to reduce the risk that the loop would fully separate and snap in a failure condition. Alternatively or in addition, in such arrangements the splice used to form the continuous loop structure may include a connection of the core components in addition to the jackets of the end portions, so that the splice is not used as a controlled failure point.

In other exemplary arrangements fibers having different elongation properties may be incorporated into a common rope segment component. For example the core or jacket may include different types of yarn materials some of which tolerate high elongation prior to separation and others of which tolerate a relatively lower elongation prior to separation. The inclusion of such yarns with different elongation and separation properties may further facilitate having multiple disposed failure points in the mooring loop so as to avoid the risk of a single failure in which the loop suffers separation.

Thus as can be appreciated the approaches described herein enable a mooring loop to have a desired range for safe working loads in which the loop resists force applied by a mooring line or other attached device without being subject to permanent elongation. In addition the mooring loop may be configured to elongate in a controlled manner responsive to forces above the range of safe working loads in which the components of mooring loop elongate without being subject to a total failure through loop separation. Further in exemplary arrangements the mooring loop may give a visual indication that it is or has been subject to loads in excess of the range of safe working loads so that the user may be aware of the need to replace the mooring loop and/or if loop is currently in service, to take additional steps to secure the vessel or other item.

Additionally, the rope segment embodied as mooring loop 10 may include or be operatively connected to sensor logic operative to provide another indication of failure at the controlled failure point 40. The logic may operate to sense impending failure of the rope segment. Sensor logic may also provide an alarm notification to an operator of failure or impending failure based on application specific design requirements. The notification of failure or impending failure may be transmitted by sensor logic or other logic. The sensor logic or other logic may include a transceiver to transmit signals to a remote device that monitors the rope, particularly at the controlled failure point 40, but as well as at other locations. In one embodiment, sensor logic may be in operative communication with or take the form of a piezoelectric fiber within the rope 26. In one particular example, the piezoelectric fiber is in the outer jacket and extends across the constriction zone 42 spanning the distance between the segmented ends of the severed inner core 30 at the controlled failure point 40. An exemplary embodiment can utilize piezoelectric fibers that can or may eliminate the need for an external power supply. "Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics. Furthermore, the logic(s) presented herein for accomplishing various methods of this system may be directed towards improvements in existing computer-centric or internet-centric technology for monitoring and controlling ropes or mooring loops that may not have previous analog versions. The logic(s) may provide specific functionality directly related to structure that addresses and resolves some problems identified herein, namely, providing an indication of potential failure for the mooring loop or mooring line. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

Thus the exemplary embodiments that have been described herein achieve improved operation, eliminate difficulties encountered in the use of prior devices and systems, and attain useful results that have been described.

In the foregoing description, certain terms have been used for brevity, clarity and understanding. However no unnecessary limitations are to be implied therefrom because such terms are used for descriptive purposes and are intended to be broadly construed. Moreover the descriptions and illustrations herein are by way of examples and the new and useful arrangements and features are not limited to the exact features shown and described.

It should further be understood that features and/or relationships associated with one arrangement can be combined with features and/or relationships from another arrangement. That is, various features and/or relationships from various arrangements can be combined to produce other arrangements. The new and useful features described in this disclosure are not limited only to the specific arrangements that have been shown and/or described.

Having described features, discoveries and principles of the exemplary arrangements, the manner in which they are constructed and operated, and the advantages and useful results attained; the new and useful features, devices, elements, arrangements, parts, combinations, systems, equipment, operations, methods, processes and relationships are set forth in the appended claims.

Moreover, the description and illustration of various embodiments of the disclosure are examples and the disclosure is not limited to the exact details shown or described.

What is claimed:

1. A mooring loop comprising:

an outer jacket and an inner core defining a rope;

a first controlled failure point in the rope defined by segmented ends that sever the inner core within the outer jacket, wherein there is only the outer jacket and there is no inner core in the rope at the first controlled failure point; and a yield strength of the first controlled failure point that is in a range of 50% to 90% of a yield strength of the rope along a portion of the rope where the outer jacket surrounds the inner core.

2. The mooring loop of claim 1, further comprising:

a constriction zone at the first controlled failure point having a reduced diameter relative to a portion of the outer jacket surrounding the inner core when the rope is placed in tension.

3. The mooring loop of claim 2, further comprising:

a constriction angle at a first segmented end of the inner core, wherein the constriction angle effectuates the outer jacket to engage the first segmented end of the inner core when the rope is placed in tension.

4. The mooring loop of claim 1, further comprising:

at least one center fiber, wherein the inner core overlays the at least one center fiber.

5. The mooring loop of claim 1, further comprising:

a ratio of volume of material of the outer jacket to volume of material of the inner core in a range from 1:1 to 8:1.

6. The mooring loop of claim 5, wherein the ratio is 4:1.

7. The mooring loop of claim 1, further comprising:

a splice connecting first and second ends of the rope to form a continuous loop.

8. The mooring loop of claim 7, further comprising:

a position of the first controlled failure point located a distance from the splice, wherein the first controlled failure point is located between first and second ends of the mooring loop.

9. The mooring loop of claim 7, further comprising:

a plurality of coils defined by the continuous loop, wherein the plurality of coils define first and second ends of the mooring loop;

wherein the first controlled failure point is located between the first and second ends of the mooring loop along one of the coils in the plurality of coils.

10. The mooring loop of claim 9, wherein the splice is located at the first end of the mooring loop and adapted to contact a bollard to ensure uniform stretch to each portion of the rope extending laterally from the splice.

11. A mooring loop comprising:

an outer jacket and an inner core defining a rope;

a first controlled failure point in the rope defined by segmented ends that sever the inner core within the outer jacket, wherein there is only the outer jacket and there is no inner core in the rope at the first controlled failure point; and wherein the inner core is composed of 150% elongation polyester fiber.

12. A mooring loop comprising:

an outer jacket and an inner core defining a rope;

a first controlled failure point in the rope defined by segmented ends that sever the inner core within the outer jacket, wherein there is only the outer jacket and there is no inner core in the rope at the first controlled failure point; and wherein the inner core is composed of twenty-four ends of 700 denier yarn.

13. A mooring loop comprising:

an outer jacket and an inner core defining a rope;

a first controlled failure point in the rope defined by segmented ends that sever the inner core within the outer jacket, wherein there is only the outer jacket and there is no inner core in the rope at the first controlled failure point; and wherein the inner core includes yarns that are each twisted in the S-direction in a range of 0.25 turns per inch to 1.25 turns per inch and are at a braid angle in a range from 30° to 60° relative to a central axis.

14. A mooring loop comprising:

an outer jacket and an inner core defining a rope;

a first controlled failure point in the rope defined by segmented ends that sever the inner core within the outer jacket, wherein there is only the outer jacket and there is no inner core in the rope at the first controlled failure point;

a plurality of twisted yarns forming the inner core;

a plurality of twisted yarns forming the outer jacket; and wherein the plurality of twisted yarns forming the inner core and the plurality of yarns forming the outer jacket are twisted in the same twist direction.

15. A mooring loop comprising:

an outer jacket and an inner core defining a rope;

a first controlled failure point in the rope defined by segmented ends that sever the inner core within the outer jacket, wherein there is only the outer jacket and there is no inner core in the rope at the first controlled failure point;

a plurality of twisted yarns forming the inner core;

a plurality of twisted yarns forming the outer jacket; and wherein some yarns of the plurality of twisted yarns forming the inner core and the plurality of yarns forming the outer jacket are configured to elongate and break at an earlier time than other yarns of the plurality of twisted yarns forming the inner core and the plurality of yarns forming the outer jacket.

16. A mooring loop comprising:

an outer jacket and an inner core defining a rope;

a first controlled failure point in the rope defined by segmented ends that sever the inner core within the outer jacket, wherein there is only the outer jacket and there is no inner core in the rope at the first controlled failure point;

a plurality of twisted yarns forming the inner core;

a plurality of twisted yarns forming the outer jacket; and wherein some yarns of the plurality of twisted yarns forming the inner core and the plurality of yarns forming the outer jacket reach maximum elongation and break at different times under loads above a yield force.

17. A mooring loop comprising:

an outer jacket and an inner core defining a rope;

a first controlled failure point in the rope defined by segmented ends that sever the inner core within the outer jacket, wherein there is only the outer jacket and there is no inner core in the rope at the first controlled failure point;

a plurality of twisted yarns forming the inner core at a first braid angle in a range from 30° to 60° relative to a central axis; and a plurality of twisted yarns forming the outer jacket at a second braid angle less than that of the first braid angle.

18. The mooring loop of claim 17, wherein the plurality of twisted yarns forming the outer jacket at the second braid angle are adapted to fail through separation before the plurality of twisted yarns forming the inner core.

* * * * *